US010828911B2

(12) United States Patent
Havive et al.

(10) Patent No.: US 10,828,911 B2
(45) Date of Patent: Nov. 10, 2020

(54) DUPLEX PRINTING

(71) Applicant: HP INDIGO B.V., Amstelveen (NL)

(72) Inventors: Moshe Koko Havive, Ness Ziona (IL); Gilad Greenberg, Ness Ziona (IL); Zvika Yogev, Ness Ziona (IL); Arnon Elihav, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/603,811

(22) PCT Filed: Apr. 25, 2017

(86) PCT No.: PCT/EP2017/059804

§ 371 (c)(1),
(2) Date: Oct. 8, 2019

(87) PCT Pub. No.: WO2018/196961

PCT Pub. Date: Nov. 1, 2018

(65) Prior Publication Data

US 2020/0114668 A1 Apr. 16, 2020

(51) Int. Cl.

| | |
|---|---|
| ***B41J 3/60*** | (2006.01) |
| ***B41J 29/393*** | (2006.01) |
| ***B41J 15/00*** | (2006.01) |
| ***B41J 25/00*** | (2006.01) |

(52) U.S. Cl.

CPC ..... *B41J 3/60* (2013.01); *B41J 15/005* (2013.01); *B41J 25/001* (2013.01); *B41J 29/393* (2013.01); *B41J 2029/3935* (2013.01)

(58) Field of Classification Search

CPC . B41J 3/60; B41J 25/001; B41J 15/005; B41J 29/393; B41J 2029/3935

See application file for complete search history.

(56) References Cited

U.S. PATENT DOCUMENTS

| | | | | |
|---|---|---|---|---|
| 6,718,872 | B2 | 4/2004 | Kanno | |
| 9,079,426 | B2 | 7/2015 | Helterline et al. | |
| 9,180,655 | B2 | 11/2015 | Peleg et al. | |
| 9,242,486 | B2 | 1/2016 | Verhofstad | |
| 2005/0174379 | A1 * | 8/2005 | Nakazawa ..... | B41J 11/46 347/19 |

(Continued)

FOREIGN PATENT DOCUMENTS

| | | |
|---|---|---|
| WO | WO-2009108204 | 9/2009 |
| WO | WO-2013119206 | 8/2013 |

OTHER PUBLICATIONS

HP PageWide Web Press T400 with Optional Zero-speed Splicer, Jan. 9, 2016 < http://www8.hp.com/h20195/v2/GetPDF.aspx/4AA3-9219ENUC.pdf >.

*Primary Examiner* — Julian D Huffman
(74) *Attorney, Agent, or Firm* — HP Inc. Patent Department

(57) ABSTRACT

A duplex printing system and method of configuring the same are described. In examples, an image, such as a test pattern, on one side of a print substrate is printed to be out of phase with an image, such as a test pattern, on the other side of the print substrate. This is achieved by adjusting a configuration of a print buffer that is located between first and second print engines of the duplex printing system. In particular examples, a length of a web within the print buffer is controlled such that the images are out of phase.

15 Claims, 4 Drawing Sheets

(56) References Cited

U.S. PATENT DOCUMENTS

| | | | | |
|---|---|---|---|---|
| 2010/0073717 | A1* | 3/2010 | Debaere | B41J 11/008 358/1.15 |
| 2010/0329756 | A1 | 12/2010 | Mizes | |
| 2011/0235118 | A1 | 9/2011 | Amir | |
| 2014/0104360 | A1* | 4/2014 | Hacker | B41J 11/0015 347/104 |
| 2016/0279978 | A1 | 9/2016 | Stephens et al. | |
| 2018/0281474 | A1* | 10/2018 | Shapiro | B41J 3/543 |

* cited by examiner

DUPLEX PRINTING

BACKGROUND

Duplex printing systems enable printing on both the front and back of a sheet of substrate. In certain systems, the sheet forms part of a continuous roll of substrate called a web. In these systems, the web is advanced through a number of printing stations. One printing station may comprise a print engine to print on the front of the substrate and another printing station may comprise a print engine to print on the back of the substrate. In certain cases, the substrate may be rotated following printing by the first print engine during passage through the printing system to the second print engine. This enables the first and second printing stations to be based on a common modular design. As well as printing stations, other stations may be provided to perform operations such unrolling the substrate, depositing primer, drying, calibrating, and finishing.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Figure 1:
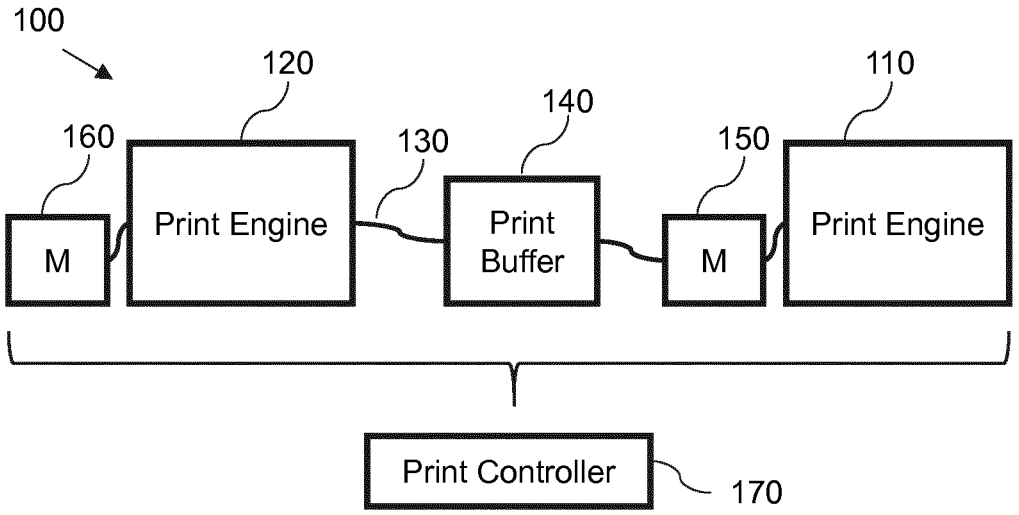
FIG. 1 is a schematic diagram of a duplex printing system according to an example.

When operating in a duplex mode, duplex printing systems are configured to synchronize the printing of images on the front and back of a print substrate. The images may comprise pages of a book, magazine or newspaper (or any other duplex application). In these cases, text and pictures on either side of a page are aligned. To enable continuous printing, the print substrate is supplied as a web, i.e. a continuous sheet of substrate that may be unwound from a first roll before printing and then wound onto a second roll after printing. As the web moves through the duplex printing system, a first or simplex print engine is arranged to print on a first side of the web (e.g. the front side) and a second or duplex print engine is arranged to print on a second side of the web (e.g. the back side).

To rapidly calibrate duplex printing systems, the two print engines of the printing system are controlled to print a test pattern on the web. The test pattern is printed at the same time by both print engines. The test pattern printed by each print engine may be a common test pattern. The web is then advanced through the printing system until the printed test pattern arrives at a set of sensors. The web may be advanced in both a forward and backward direction through the printing system. The sensors measure properties of the test pattern. These may be color properties. These measured properties are then used to calibrate the print system. For example, they may be used to perform a color calibration and/or align printed images.

In certain duplex printing systems, it has been noted that calibration and/or configuration of the printing system is variable. Following investigation, it is noted that an arrangement of a duplex printing system may cause an image, such as a test pattern, printed on the front of the print substrate to be aligned with an image, such as a test pattern, printed on the back of the print substrate. This has an effect that a measurement of the image on one of the sides is influenced by the presence of the image on the other of the sides. For example, measurement of a test area containing yellow on one side may produce different readings depending on whether a test area containing black or magenta is printed on the other side.

Certain examples described herein seek to minimize a variability of calibration and/or configuration of a duplex printing system. In these examples, an image, such as a test pattern, on one side of the print substrate is printed to be out of phase with an image, such as a test pattern, on the other side of the print substrate. This is achieved by adjusting a configuration of a print buffer that is located between first and second print engines of the duplex printing system. In particular examples, a length of a web within the print buffer is controlled such that a web length between the first and second print engines is indivisible by a sum of a measurement travel distance and a length of a print frame containing the image, the measurement travel distance being a web travel distance between a set of sensors and each print engine.

FIG. 1 shows a duplex printing system 100 according to an example. It is to be noted that certain Figures are schematic diagrams provided to better understand the described examples, and that certain features of a duplex printing system may be omitted for clarity of explanation; other examples may have a different arrangement of components, and may omit, combine or add components, depending on particular implementations.

The duplex printing system 100 of FIG. 1 comprises a first print engine 110 and a second print engine 120. The first print engine 110 is arranged to print on a first side of a web 130 of print substrate. The second print engine 120 is arranged to print on a second side of the web 130. One of the print engines may be referred to as a simplex print engine, i.e. a print engine to print on a front side of a print substrate, and the other print engine may be referred to as a duplex print engine, i.e. a print engine to print on a back side of the print substrate.

In FIG. 1, the web 130 of print substrate comprises a continuous sheet of print substrate that passes through various components and stations of the duplex printing system. In this sense, the printing system may also be referred to as a continuous web press. The print substrate may comprise, amongst others, paper, card, films, polymers, and fabrics. The print substrate may be supplied on a roll at a start of the duplex printing system 100. It then may be stored on another roll following printing at an end of the duplex printing system 100. The web 130 is formed by the extent of continuous print substrate as it passes through the duplex printing system 100, having been unwound from the start roll and rewound onto the end roll. In certain implementations, the print substrate may be subject to priming, drying, calibrating, cutting and finishing as it passes through the duplex printing system 100. These operations may be performed by specific stations of the duplex printing system 100. The web 130 may have varying widths and thicknesses, depending on the properties of the print substrate.

The duplex printing system 100 of FIG. 1 comprises a print buffer 140 located between the first print engine 110 and the second print engine 120. The print buffer 140 may be configured to hold print substrate to accommodate different operations within the duplex printing system 100. For example, the print buffer 140 may be used to accommodate different web speeds between the two print engines. The print buffer 140, and any additional print buffers of the duplex printing system 100, may also accommodate different web speeds between other stations, such as those discussed above. These differences in web speeds may be temporary as the web is fed and advanced through the duplex printing system 100 and/or as various stations perform operations on the print substrate. Print buffers, including buffer 140, are used to coordinate different web speeds by adjusting variable length substrate paths within the buffers. An example print buffer is described in more detail in FIGS. 2 and 4. In FIG. 1, the print buffer 140 receives the web 130 from the first print engine 110 and supplies the web 130 to the second print engine 120.

In certain cases, the print buffer 140 is arranged to rotate the web 130 during transit. For example, if the first and second print engines 110, 120 are arranged to print on a top side of the web 130, the print buffer 140 may rotate the web 130 so that the second print engine 120 prints on the back of the web 130. This rotation configures the printing system for duplex printing. In other cases, a separate station or component may rotate the web, e.g. a component other than the print buffer 140 or one of the print engines. If the print buffer 140 is arranged to rotate the web 130, it may be configured for simplex printing by not rotating the web 130 during transit. In yet other cases, as discussed elsewhere, the first and second print engines 110, 120 may be arranged for duplex printing without rotation of the web 130.

The duplex printing system 100 further comprises a first measurement station 150 located after the first print engine 110 and a second measurement station 160 located after the second print engine 120. As set out above, the arrangement of FIG. 1 is provided as an example and other arrangements may be possible. For example, in another example, one measurement station may be provided between the two print engines 110, 120, wherein the web 130 is advanced forwards and backwards so as to measure properties of print output from both engines. Similarly, in certain implementations other components may be located on the web path that are not shown in FIG. 1, for example a dryer or maintenance station may be located between each print engine and the measurement station, or one or more measurement stations may be integrated into the print buffer 140 or the print engines themselves.

The first and second measurement stations 150, 160 are arranged and configured to measure properties of an image printed on the web 130 by respective print engines 110, 120. The properties may comprise color properties. The image may comprise a color calibration test pattern. Each image may be located within a print frame. During a print operation, the images may comprise text and graphics. A print frame may thus set the maximum height and width of a printed image. In FIG. 1, the first measurement station 150 measures properties of an image printed on the first side of the web 130 by the first print engine 110 and the second measurement station 160 measures properties of a second image printed on the second side of the web 130 by the second print engine 120. Each measurement station may comprise a spectrophotometer to measure color properties of an image. Each measurement station may also comprise other sensors and scanners, such as an inline scanner, to measure and/or capture a printed image.

Lastly, the duplex printing system 100 of FIG. 1 comprises a print controller 170. The print controller 170 is configured to control one or more of the components of the duplex printing system 100. The print controller 170 may comprise at least one processor and memory, wherein instructions are retrieved from the memory and executed by the at least one processor to control the components. The print controller 170 may be directly and/or indirectly electrically coupled to the components of the duplex printing system 100, and may comprise a number of processors operating together to control the system.

In the example of FIG. 1, the print controller 170 is configured to adjust a length of the web 130 held within the print buffer 140 prior to printing images with the first and second print engines 110, 120 such a first image printed on a first side of the web 130 by the first print engine 110 is out of phase with a second image printed on a second side of the web 130 by the second print engine 130. In other words, the print buffer 140 is controlled such that the first and second images are printed on an area of substrate that has a white or blank substrate backing. This ensures that measurements made by the measurement stations 150, 160 are not influenced by the presence of an image on another side of the substrate. The first and second print engines 110, 120 are controlled, e.g. by the print controller 170, to print at the same time, i.e. the first print engine 110 prints on the first side of the web at the same time as the second print engine 120 prints on the second side of the web. Following a test or calibration routine, the print controller 170 may be configured to reset the print buffer 140 to a setting such as a default setting where the first and second images are aligned with each other on the front and back of the web. This may enable a print job to be started.

The measurements made by the measurement stations 150, 160 may comprise measured color properties, e.g. as measured using a colorimeter and/or spectrophotometer, that are used to color calibrate the duplex printing system 100. In one example, the first and second print engines 110 and 120 are instructed to print, in a synchronized manner, test images on the web. These test images are then advanced by a web transport system from the first and second print engines to the respective first and second measurement stations for measurement. This may occur repeatedly such that a plurality of spaced test images are printed upon the web. This control may performed by print controller 170 or by an external color calibration computing system.

In one example, the duplex printing system 100 may further comprise an unwinder to support a roll of print substrate for supply to the first print engine 110 as the web 130, a rewinder to support a roll of print substrate received as the web 130 from the second print engine 120; and a web transport system, such as that discussed above, to advance the web 130 through the duplex printing system 100 from the unwinder to the rewinder via the first print engine 110, print buffer 140 and second print engine 120. As discussed above, the unwinder and rewinder may respectively supply and receive the web 130 directly or indirectly, i.e. one or more additional components may be located between the unwinder and rewinder and the respective print engines. For example, in FIG. 1 a rewinder would receive the web from at least measurement station 160.

An example of configuring the duplex printing system 100 of FIG. 1 will now be described with reference to FIGS. 2 to 5.

Figure 2:
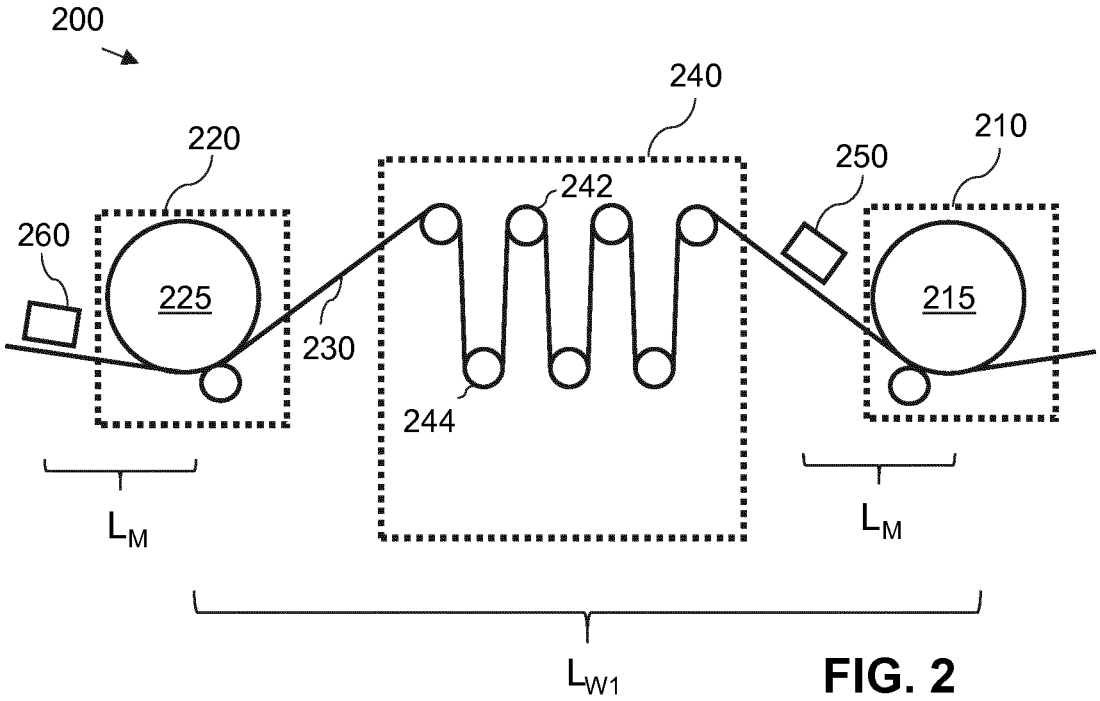
FIG. 2 is a schematic diagram of certain components of an example duplex printing system in a first configuration.

FIG. 2 shows certain components of an example duplex printing system 200 in a first configuration. The duplex printing system 200 may comprise an implementation of duplex printing system 100 or another continuous web press.

FIG. 2 shows a simplex print engine 210 and a duplex print engine 220. These print engines may implement print engines 110 and 120 from FIG. 1. Each print engine 210, 220 comprises respective print apparatus 215, 225 where an image is applied to a web 230 of print substrate. The print apparatus 215, 225 may comprise inkjet or electrostatic print apparatus.

In FIG. 2, the duplex printing system 200 comprise a print buffer 240 between the simplex and duplex print engines 210, 220. The print buffer 240 may implement print buffer 140 in FIG. 1. In FIG. 2, the print buffer 240 comprises a plurality of rollers 242, 244 arranged in two opposing groups. For example, a first group of one or more rollers 242 may be vertically spaced from a second group of one or more rollers 244. The rollers 242, 244 may be driven rollers and/or idlers (i.e. non-driven or freely rotating rollers).

Following each print engine 210, 220 is a respective measurement station 250, 260. These measurement stations 250, 260 may implement measurement stations 150, 160. In FIG. 2, both print apparatus 215, 225 are arranged to print on the top of the web 230. In this case, the print buffer 140, or another component, such as a turn bar, may be arranged to rotate the web 230 (not shown for clarity).

In the first configuration of FIG. 2, a number of web lengths are defined. Each print engine 210, 220 is spaced from each respective measurement station 250, 260. As such, there is a first web length or distance, $L_M$, between a location of print using the print apparatus 215, 225 and a location of measurement using the measurement stations 250, 260. This first length or distance may incorporate additional rollers and/or turns or loops of substrate along a web transport system. As such, it may also be defined as a web travel distance between each print engine and a respective measurement station. In a test implementation, $L_M$ equals 4 m. In the present example, the web length $L_M$ is assumed to be equal for each print engine as each print engine has a common modular configuration; however, in certain implementations it may differ for each print engine. There is then a second web length or distance $L_{W1}$ that defines a length of web between a print location for the simplex print apparatus 215 and a print location for the duplex print apparatus 225. Again, this web length or distance may incorporate additional rollers and/or turns or loops of substrate along a web transport system. It also incorporates a length of web that is held within the print buffer 240. For example, in FIG. 2, the length of web that is held within the print buffer 240 is larger than a distance between web entry and exit points for the buffer, due to the looping of the web around the rollers 242, 244.

Figure 3:
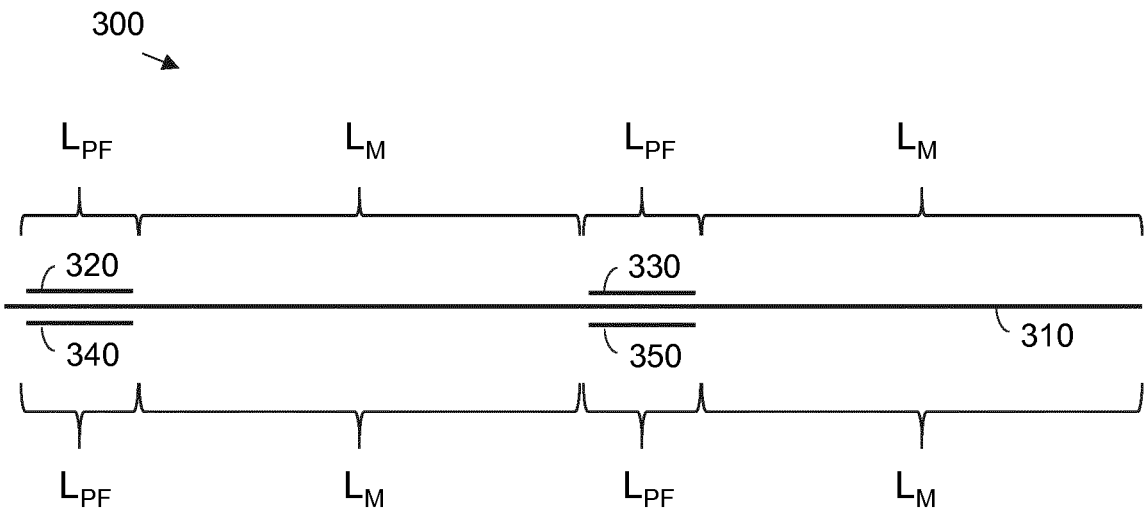
FIG. 3 is a schematic diagram of a length of print substrate that is printed using the first configuration shown in FIG. 2.

FIG. 3 illustrates an issue that may arise when printing with the first configuration of FIG. 2. FIG. 3 schematically shows a portion 300 of a web 310 from the side. A first image 320 is printed at a first location on a first or top side of the print substrate. A second image 330 is then printed at a second location on the first or top side of the print substrate. This sequence of images may result from repeated instructions to: print a first test pattern with print engine 210, advance the web to the first measurement station 250, and measure properties of the test pattern. In FIG. 3, the images are printed with a print frame. The print frame has a length on the web of $L_{PF}$. This may be referred to as a print frame or image length. Each image is spaced by the first web length $L_M$, which represents the distance travelled from the print engine 210 to the first measurement station 250. Hence, the images on the first or top side of the web may be considered to be a one-dimensional wave-form, where the images are repeated at a fixed frequency by the operation of the duplex printing system 200.

After the images on the first or top side of the web 310 are printed, the web is advanced through the duplex printing system 200 to the second print engine 220. During the advance, the web 230 may be rotated by 180 degrees to print on a second or bottom side of the web. In other examples, the second print apparatus 225 may be oriented to print on the other side of the substrate, e.g. the apparatus 225 may be rotated by at 180 degrees as compared to the simplex print apparatus 215. In the first configuration of FIG. 2, the second web length or distance $L_{W1}$ is a multiple of the first web length or distance, $L_M$, and the print frame length $L_{PF}$, i.e. $L_{W1}=m*(L_M+L_{PF})$. This results in the second print engine 220 printing a third image 340 opposite the first image 320, i.e. such that the locations of the images along the web overlap. This may be suitable and desired for a standard print operation. However, when the third image 340 is advanced to the second measurement station 260, there is a chance of a measurement error or discrepancy due to the presence of the first image 320 in the reverse side of the web. For example, a yellow printed within the third image 340 may have a different measured color property depending on whether it backs onto a black or magenta portion of the first image 320.

Figure 4:
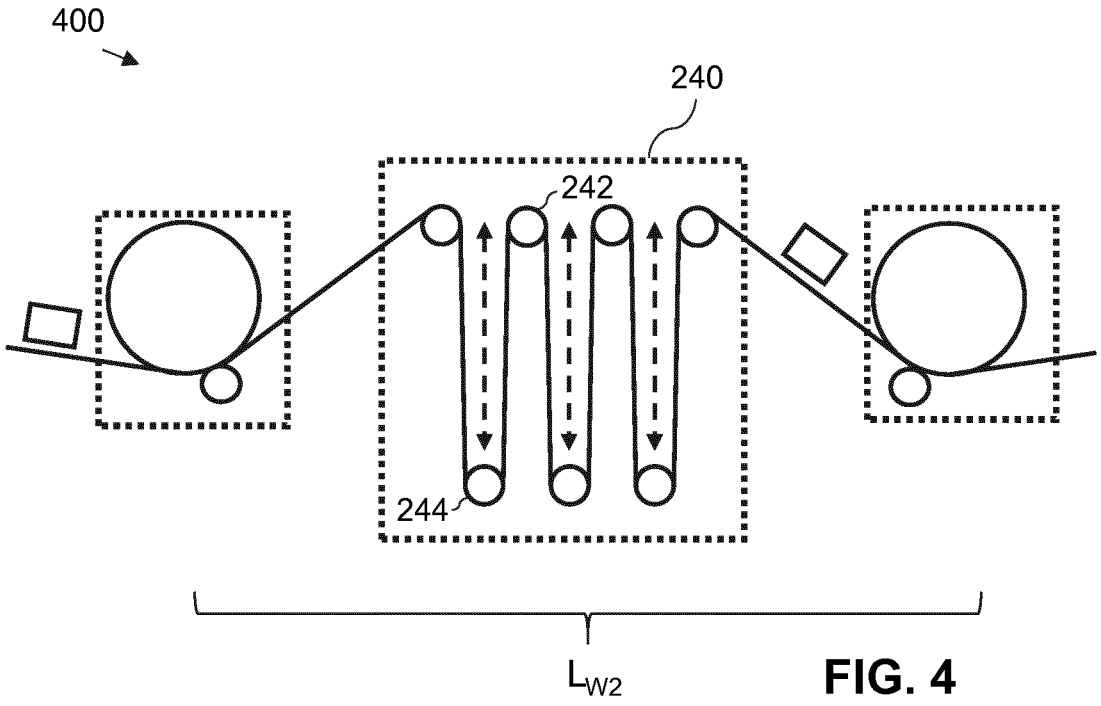
FIG. 4 is a schematic diagram of certain components of an example duplex printing system in a second configuration.

FIG. 4 shows a second configuration 400 of the duplex printing system 200 to avoid the coincident images of FIG. 3. This configuration may be enacted during a calibration routine, with the printing system being returned to the configuration of FIG. 2 for standard printing. Other aspects of the configuration may remain the same.

In the print buffer 240 shown in FIG. 4, a position of at least one of the groups of rollers 242, 244 is adjustable with respect to the other group so as to modify a length of web 230 held within the print buffer 240. In FIG. 4, the vertical distance between the rollers is extended so as to hold an increased length of web within the print buffer 240. This changes the second web length or distance $L_{W1}$ to $L_{W2}$, i.e. due to the increased length of web within the print buffer 240. The print buffer 240 is adjusted such that $L_{W2}$ does not equal a multiple of the first web length or distance $L_M$ plus the print frame length $L_{PF}$ (i.e. such that $L_{W2}\neq m*(L_M+L_{PF})$). Put another way, the print buffer 240 is adjusted such that a web length between the simplex and duplex print engines 210, 220 is indivisible by a sum of a measurement travel distance and a length of the print frames.

Figure 5:
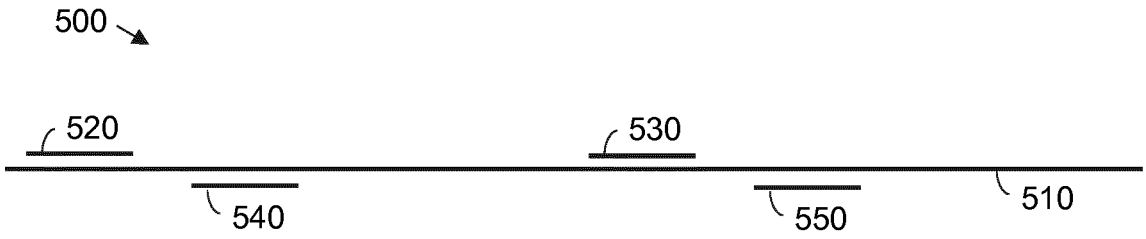
FIG. 5 is a schematic diagram of a length of print substrate that is printed using the second configuration shown in FIG. 4.

FIG. 5 shows an example portion 500 of a web 510 as generated using the second configuration of FIG. 4. As can be seen the first and second images 520 and 530 on the top of the web 510 are out of phase with the third and fourth images 540 and 550 on the bottom of the web 510. Or put differently, a length of the web within the print buffer 240 is adjusted such that an image printed on the first side of the web by the simplex print engine 210 is in a first location along the web and an image printed on the second side of the web by the duplex print engine 220 is in a second location along the web, the first location being different from the second location. This means that each image 520, 530, 540, 550 backs onto white or blank substrate and thus ensures correct measurement by the measurement stations.

Figure 6:
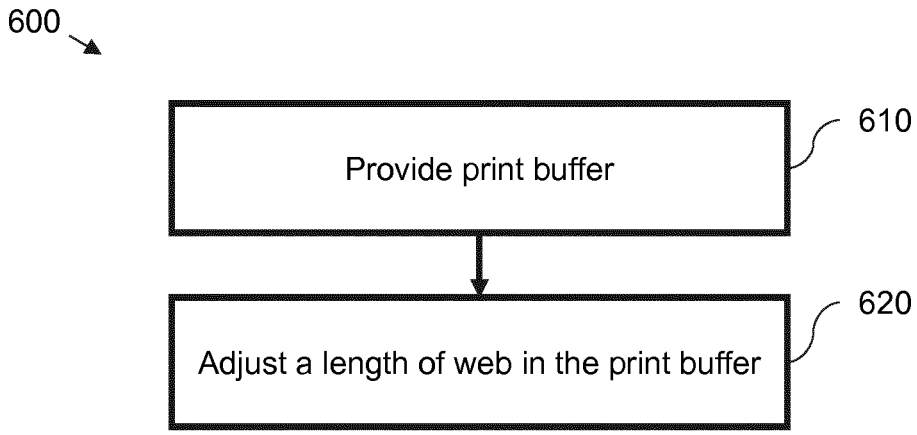
FIG. 6 is a flow diagram showing a method of configuring a duplex printing system according to an example.

FIG. 6 shows a method 600 of configuring a duplex printing system, such as a continuous web press, according to an example. This method may be applied in the context of the duplex printing systems 100 and 200 of FIGS. 1 and 2, e.g. it may implement the transition between the first and second configurations of FIGS. 2 and 4.

The method 600 begins with a block of providing a print buffer 610 between a first print engine and a second print engine of the duplex printing system. These may be simplex and duplex print engines. Each print engine is synchronized with the other, e.g. is controllable to print an image at the same time, and is arranged to print on a respective side of a web of print substrate.

The method 600 then comprises a block of adjusting a length of the web within the print buffer 620. This adjustment is made such that a color calibration test pattern printed on a first side of the web by the first print engine is out of phase with a color calibration test pattern printed on a second side of the web by the second print engine.

In certain examples, block 620 may comprise obtaining a travel distance between each print engine and a respective measurement station arranged to measure color properties of the color calibration test patterns. For example, this distance may be based on a time for a test pattern to travel from the print engine to the measurement station at a predetermined speed. The travel distance may, for example, be stored as a variable in memory. Block 620 may also comprise obtaining an estimated pattern length, on the web, of the color calibration test patterns when printed. This may comprise retrieving a fixed print frame length, e.g. from an accessible memory. In these examples, adjusting a length of the web within the print buffer comprises adjusting the length of the web within the print buffer such that a length of the web between the first and second print engines does not comprise a multiple of a sum of the travel distance and the estimated pattern length. For example, the length of the web between the first and second print engines may be a function of the travel distance between the two print engines excluding the print buffer and a length of web held within the print buffer, wherein the latter may be adjustable. The travel distance between the two print engines excluding the print buffer may depend on the absolute distance between the print engines and/or a web transport path between the print engines, e.g. the travel distance may incorporate one or more loops as the web is transported between rollers of a web transport system.

In one example, adjusting a length of the web within the print buffer at block 620 comprises adjusting a roller extension parameter for the print buffer. For example, as shown in FIG. 4, a distance between opposing sets of rollers may be adjustable. This may be performed by moving one or more of the groups of rollers 242, 244 (e.g. the second group 244 is moved vertically downwards in FIG. 4). The roller extension parameter may indicate a spacing between the opposing set of rollers. It may be defined as a percentage or proportion of a maximum spacing.

In comparative printing operations, a print buffer may be set to a 50% extension as a default, e.g. wherein rollers 242 in FIG. 4 are spaced from rollers 244 at 50% of a maximum spacing. FIG. 2 shows an example of a default 50% extension. This may be used for a print job. An extension of 0% may indicate the rollers 242 and 244 are vertically aligned and/or separately by a predetermined minimum spacing. An extension of 100% may indicate the rollers 242 and 244 are separately by a predetermined maximum vertical spacing. In a case, where the print buffer is arranged to hold a maximum of 5 m of web, a 50% default spacing may enable 2.5 m of web to be fed into the print buffer by the first print engine when the web on the side of the second print engine is stationary, e.g. by increasing the roller extension parameter to 100%; or 2.5 m of web to be fed out of the print buffer by the second print engine when the web on the side of the second print engine is stationary, e.g. by decreasing the roller extension parameter to 0%. A 50% value may be provided as a default setting as it enables both the first and second print engines to change web speeds and/or stop without tearing or crumbling the web.

Where a print buffer is set to a 50% extension as a default, and a front image is printed in phase with a back image, the adjustment of block 620 may comprise setting the roller extension parameter to, amongst others, 25% or 75%. This may be applied for the calibration, with the setting being returned to its default value for the printing of a print job. Both of these settings change the length of web within the print buffer so as to cause the front image to be printed out of phase with the back image. Or put another way, if a set of front images have a fixed frequency and a phase of 0 then adjusting the print buffer introduces a phase difference or offset with respect to the set of back images, i.e. these have a phase >0.

In certain examples, the print buffer may be controlled directly, e.g. by print controller 170, based on a roller extension parameter. For example, the print controller 170 may control actuators to move rollers 242 and/or 244 based on the roller extension parameter. In other examples, the print buffer may be controlled indirectly, e.g. by controlling a length and/or speed of web that is fed into or fed out of the buffer (i.e. that is pushed into or pulled out of the buffer). For example, the second print engine may be instructed to pull a predetermined portion of the web from the print buffer or the first print engine may be instructed to push a predetermined portion of the web into the print buffer. This may be achieved by setting particular web speeds in the first and/or second print engines, e.g. as part of pre-printing routine.

Figure 7:
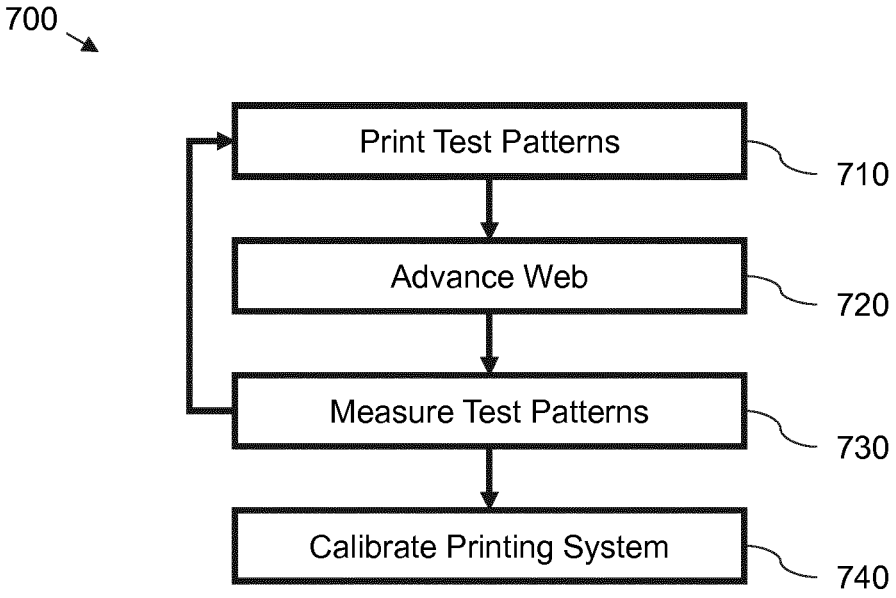
FIG. 7 is a flow diagram showing a method of calibrating a duplex printing system according to an example.

FIG. 7 shows a method 700 of color calibrating a duplex printing system according to an example. Method 700 may follow the method 600 of FIG. 6.

At block 710, color calibration test patterns are printed, in a synchronized manner, with the first and second print engines, i.e. at a time ti both print engines print a color calibration test pattern as a frame of print data. At block 720, the web within the duplex printing system is advanced from the first and second print engines to the respective measurement stations. This may comprise activating a web transport at a fixed speed for a predetermined time period, the speed and time period being selected such that the color calibration test patterns travel from the first and second print engines to the respective measurement stations. At block 730, the color calibration test patterns are measured at respective measurement stations. At block 740, the duplex printing system is calibrated based on the measured color calibration test patterns. This may comprise configuring color mappings within the duplex printing system such that a color defined in a color space such as RGB or CMYK color space is printed as a color that has measured properties that correspond to controlled or factory measurements (e.g. 'ideal' conditions).

At shown in FIG. 7, blocks 710, 720 and 730 may be repeated in a loop. In this case, calibrating the duplex printing system comprises iteratively calibrating the duplex printing system based on a plurality of measured color calibration test patterns, wherein the color calibration test patterns are repeated with a fixed frequency along the web. For example, a first set of test patterns may be measured, calibration may be performed based on those measurements, and a further set of calibration test patterns may be printed to confirm that adjustments to color systems of the print engines are moving the measured properties closer to a set of desired measurements. This may be repeated until the measured properties are within a tolerance of the desired measurements. In certain cases, the measured color properties from the first measurement station are used by the duplex printing system to color calibrate the first print engine and the measured color properties from the second measurement station are used by the duplex printing system to color calibrate the second print engine.

Figure 8:
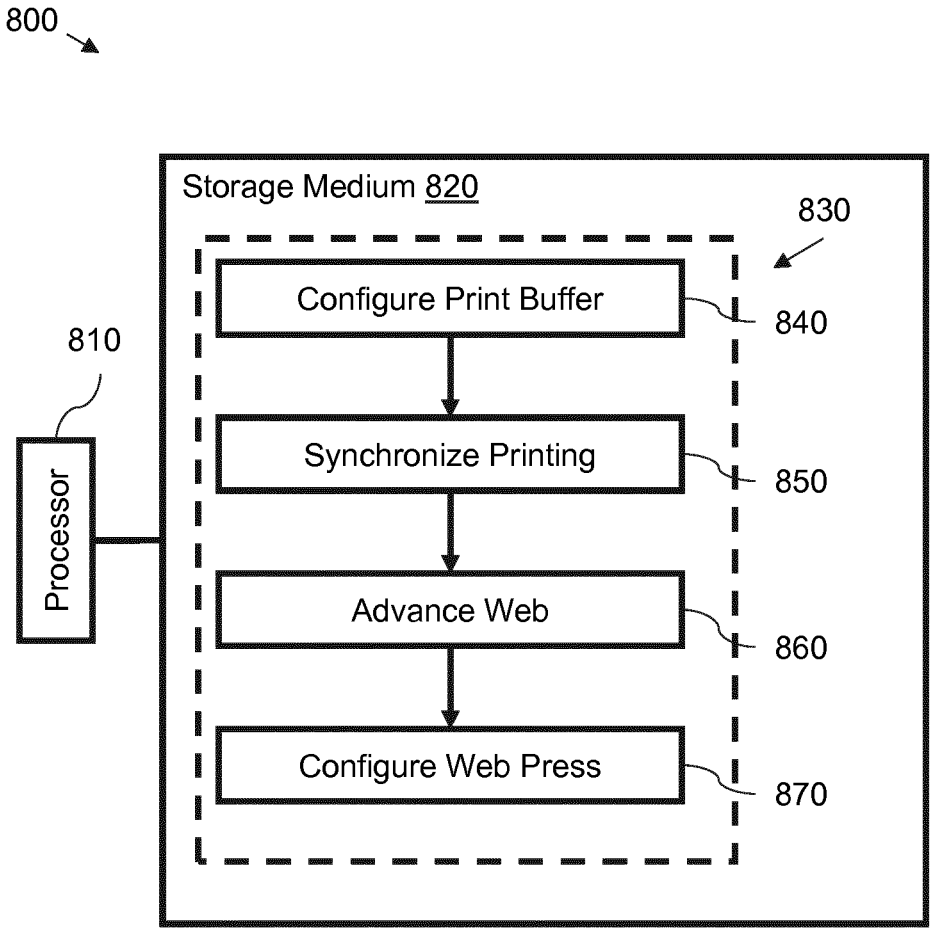
FIG. 8 is a schematic diagram of a computer-readable storage medium according to an example.

FIG. 8 shows a computer device 800 comprising at least one processor 810 and a non-transitory machine-readable storage medium 820 storing instructions 830 for execution by said processor. The computer device 800 may form part of a control system for a continuous web press. The computer-readable storage medium 820 may comprise any machine-readable storage media, e.g. such as a memory and/or a storage device. Machine-readable storage media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc. In one case, the at least one processor 810 may be arranged to store instructions 820 in memory such as RAM to implement the methods and/or print controller described above.

A first instruction 840 causes the processor 810 to configure a print buffer of the continuous web press, the print buffer being located between simplex and duplex print engines of the continuous web press. This may comprise adjusting the print buffer as described above. A second instruction 850 causes the processor 810 to synchronize printing of respective print frames by the simplex and duplex print engines. A third instruction 860 causes the processor 810 to advance the web through the continuous web press until the print frames are located at a set of sensors, such as the previously described measurement stations. A fourth instruction 870 then causes the processor 810 to configure the continuous web press based on data received from the set of sensors.

In this example, the instruction 840 also causes the processor to configure the print buffer by setting a web length within the print buffer such that a web length between the simplex and duplex print engines is indivisible by a sum of a measurement travel distance and a length of the print frames, the measurement travel distance being a web travel distance between the set of sensors and each print engine. This ensures that simplex print frames are out of phase with duplex print frames. In certain cases, at least the instructions to synchronize printing of respective print frames and to advance the web through the continuous web press are repeated so as to configure the continuous web press based on a repeated set of print frames along the web.

The preceding description has been presented to illustrate and describe examples of the principles described. This description is not intended to be exhaustive or to limit these principles to any precise form disclosed. Many modifications and variations are possible in light of the above teaching. For example, as well as color calibration, the method may be applied to other test patterns such that they are provided out of phase on the web, such as alignment patterns. It is to be understood that any feature described in relation to any one example may be used alone, or in combination with other features described, and may also be used in combination with any features of any other of the examples, or any combination of any other of the examples.

What is claimed is:

1. A method of configuring a duplex printing system comprising:

providing a print buffer between a first print engine and a second print engine of the duplex printing system, each print engine being synchronized with the other and arranged to print on a respective side of a web of print substrate; and adjusting a length of the web within the print buffer such that a color calibration test pattern printed on a first side of the web by the first print engine is out of phase with a color calibration test pattern printed on a second side of the web by the second print engine.

2. The method of claim 1, wherein adjusting a length of the web within the print buffer comprises adjusting a roller extension parameter for the print buffer.

3. The method of claim 1, wherein adjusting a length of the web within the print buffer comprises instructing the second print engine to pull a predetermined portion of the web from the print buffer.

4. The method of claim 1, wherein adjusting a length of the web within the print buffer comprises instructing the first print engine to push a predetermined portion of the web into the print buffer.

5. The method of claim 1, comprising:

obtaining a travel distance between each print engine and a respective measurement station arranged to measure color properties of the color calibration test patterns; and obtaining an estimated pattern length, on the web, of the color calibration test patterns when printed, wherein adjusting a length of the web within the print buffer comprises adjusting the length of the web within the print buffer such that a length of the web between the first and second print engines does not comprise a multiple of a sum of the travel distance and the estimated pattern length.

6. The method of claim 5, comprising:

printing, in a synchronized manner with the first and second print engines, the color calibration test patterns;

advancing the web within the duplex printing system from the first and second print engines to the respective measurement stations;

measuring, at the respective measurement stations, the color calibration test patterns; and calibrating the duplex printing system based on the measured color calibration test patterns.

7. The method of claim 6, comprising:

repeating the printing, advancing and measuring operations, wherein calibrating the duplex printing system comprises iteratively calibrating the duplex printing system based on a plurality of measured color calibration test patterns, and wherein the color calibration test patterns are repeated with a fixed frequency along the web.

8. A duplex printing system comprising:

a first print engine arranged to print on a first side of a web of print substrate;

a first measurement station to measure color properties of an image printed on the first side of the web by the first print engine;

a second print engine arranged to print on a second side of the web at the same time as the first print engine prints on the first side of the web;

a second measurement station to measure color properties of a second image printed on the second side of the web by the second print engine;

a print buffer located between the first and second print engines; and a print controller to adjust a length of the web held within the print buffer prior to printing the test images with the first and second print engines such the first image is out of phase with the second image.

9. The duplex printing system of claim 8, wherein each measurement station comprises a spectrophotometer.

10. The duplex printing system of claim 8, wherein:

the print buffer comprises a plurality of rollers arranged in two opposing groups, and a position of at least one of the groups of rollers is adjustable with respect to the other group so as to modify a length of web held within the print buffer.

11. The duplex printing system of claim 8, wherein the measured color properties from the first measurement station are used by the duplex printing system to color calibrate the first print engine and the measured color properties from the second measurement station are used by the duplex printing system to color calibrate the second print engine.

12. The duplex printing system of claim 8, comprising:

an unwinder to support a roll of print substrate for supply to the first print engine as the web;

a rewinder to support a roll of print substrate received as the web from the second print engine; and a web transport system to advance the web through the duplex printing system from the unwinder to the rewinder via the first print engine, print buffer and second print engine.

13. The duplex printing system of claim 12, wherein the print controller is configured to repeatedly:

instruct the first and second print engines to print, in a synchronized manner, test images on the web; and instruct the web transport system to advance the test images on the web from the first and second print engines to the respective first and second measurement stations.

14. A non-transitory machine-readable storage medium storing instructions that, when executed by a processor of a continuous web press, cause the processor to:

configure a print buffer of the continuous web press, the print buffer being located between simplex and duplex print engines of the continuous web press;

synchronize printing of respective print frames by the simplex and duplex print engines;

advance the web through the continuous web press until the print frames are located at a set of sensors; and configure the continuous web press based on data received from the set of sensors, wherein the instructions cause the processor to configure the print buffer by setting a web length within the print buffer such that a web length between the simplex and duplex print engines is indivisible by a sum of a measurement travel distance and a length of the print frames, the measurement travel distance being a web travel distance between the set of sensors and each print engine.

15. The medium of claim 14, wherein at least the instructions to synchronize printing of respective print frames and to advance the web through the continuous web press are repeated so as to configure the continuous web press based on a repeated set of print frames along the web.

* * * * *